US010100625B2

(12) United States Patent
Barak et al.

(10) Patent No.: US 10,100,625 B2
(45) Date of Patent: Oct. 16, 2018

(54) METHOD OF THERMOBARIC PRODUCTION OF HYDROCARBONS

(71) Applicant: Galex Energy Corp., Houston, TX (US)

(72) Inventors: Alexander M. Barak, Houston, TX (US); Anatolii Bazhal, Houston, TX (US)

(73) Assignee: Galex Energy Corp., Houston, TX (US)

( * ) Notice: Subject to any disclaimer, the term of this patent is extended or adjusted under 35 U.S.C. 154(b) by 0 days.

(21) Appl. No.: 15/433,576

(22) Filed: Feb. 15, 2017

(65) Prior Publication Data

US 2017/0241248 A1 Aug. 24, 2017

Related U.S. Application Data

(60) Provisional application No. 62/298,778, filed on Feb. 23, 2016, provisional application No. 62/297,978, filed on Feb. 22, 2016, provisional application No. 62/298,086, filed on Feb. 22, 2016, provisional application No. 62/298,110, filed on Feb. 22, 2016, provisional application No. 62/298,021, filed on Feb. 22, 2016.

(51) Int. Cl.

| | |
|---|---|
| ***E21B 43/24*** | (2006.01) |
| ***E21B 43/243*** | (2006.01) |
| ***E21B 43/16*** | (2006.01) |
| *E21B 43/04* | (2006.01) |

(52) U.S. Cl.

CPC ..... *E21B 43/243* (2013.01); *E21B 43/166* (2013.01); *E21B 43/04* (2013.01)

(58) Field of Classification Search

CPC ..... E21B 43/2401; E21B 36/04; E21B 43/24; E21B 43/30; E21B 43/243; E21B 43/2403; E21B 43/281; E21B 43/2408

See application file for complete search history.

(56) References Cited

U.S. PATENT DOCUMENTS

| | | | | |
|---|---|---|---|---|
| 7,980,312 | B1 * | 7/2011 | Hill | E21B 43/24 166/272.2 |
| 2009/0050318 | A1 * | 2/2009 | Kasevich | E21B 43/003 166/248 |
| 2010/0258265 | A1 * | 10/2010 | Karanikas | E21B 43/243 165/45 |

* cited by examiner

*Primary Examiner* — Zakiya W Bates

(74) *Attorney, Agent, or Firm* — Kelly & Kelley, LLP

(57) ABSTRACT

A process for the thermobaric production of hydrocarbons from natural reservoirs through conventional wells. The hydrocarbons are converted into corresponding vapor phase fractions in the downhole, through the use of a combination of gasifying agents, heated atmospheric air, and steam—all pumped into the downhole. Temperature and pressure gradients that develop in the reservoir lead to disintegration of low-porosity rock and decompaction of impermeable rock. The vapor phase fractions are recovered at the well head and condensed on-site into high quality liquid and gaseous products.

19 Claims, 4 Drawing Sheets

METHOD OF THERMOBARIC PRODUCTION OF HYDROCARBONS

RELATED APPLICATIONS

This application claims priority to U.S. Provisional Application No. 62/297,978, filed on Feb. 22, 2016, U.S. Provisional Application No. 62/298,021, filed on Feb. 22, 2016, U.S. Provisional Application No. 62/298,086, filed on Feb. 22, 2016, U.S. Provisional Application No. 62/298,110, and U.S. Provisional Application No. 62/298,778, filed on Feb. 23, 2016.

BACKGROUND OF THE INVENTION

The present invention relates to the recovery of hydrocarbons from their natural depths of occurrence via conventional wells. More particularly, the present invention relates to the thermobaric production of such hydrocarbons, e.g., by first converting them into a gaseous state underground. The invention may be used to produce liquid, solid and gaseous hydrocarbons, including coal, heavy and bituminous oil, and dissipated (shale) hydrocarbons.

FIELD OF THE INVENTION

It is well established that the rates and volumes of hydrocarbon (HC) recovery are dependent on the physicochemical properties of the target resources, their depth of occurrence, the permeability of the host rock and other factors. Underground gasification of hydrocarbons with varying physicochemical properties will improve both well productivity and the completeness of recovery of such HC resources as coal, heavy and bituminous oil, and dissipated (shale) hydrocarbons.

A documented method of hydrocarbon gasification, based on the example of brown coal, involves gasifying a thick coal seam under a surface-based system through purpose-drilled wells. To achieve this, a group of wells is drilled at wellbore angles that are lower than the dip angles of the overlying rock. A gasifying agent is then injected downhole through the wells until the reaction zone passes through their wellbores, after which the same wells are used to recover the resulting gas. Prior to the start of gasification, compressed air is injected into the coal seam to create, through combustion, narrow channels to improve permeability between the wells, which are spaced approximately 50 meters apart. This method has been proven under commercial conditions.

A drawback of this method is that well efficiency is low under a surface-based gasification system, since the process results in the recovery of combustion products rather than useful gas. These products are created as a result of the combustion of newly formed, potentially useful gas in the burned-through interwell channels, where it becomes intermixed with the original gasifying agent. Another deficiency of this method is that it requires the formation of burned-through interwell channels, which further complicates the gasification process.

The method that most closely approximates the subject of this application involves in-situ gasification of solid and fluid hydrocarbons by drilling into the target HC accumulation, injecting gasifying components into said accumulation through the well tubing, and recovering the resultant gas at the wellhead. Hydrocarbon accumulations are penetrated by a group of wells drilled to a point beneath the productive section by drilling below the underlying rock to a specified depth. Volumetric dilatant pore-formation occurs in the rock mass. At least one hollow volume-reactor is formed in the underlying rock within the interval drilled below the oil bearing zone. A productive high-temperature gas-vapor mixture accumulates in the upper zone of the target reservoir, from where it is directed to the wellhead for recovery.

A deficiency of this method is its sub-optimal and poorly controlled systems of heat formation in the space of the hollow volume-reactor and heat-and-mass transfer of the flowing fractions from the high-temperature zone deep below the gasified hydrocarbon mass through the permeable pore space of said gasified hydrocarbon mass, and not through the surface of contact with the high-temperature source of thermal energy.

Accordingly, there is a need for a process that improves the recovery of hydrocarbons and hydrocarbon fractions from natural wells. The present invention fulfills these needs and provides other related advantages.

SUMMARY OF THE INVENTION

The purpose of this invention is to create a method for the production of hydrocarbons that increases well productivity and improves the production-efficiency of hydrocarbons with varying physicochemical properties, such as coal, heavy and bituminous oil, and dissipated (shale) hydrocarbons.

More specifically, the purpose of this invention is to create a method for the production of hydrocarbons with varying physicochemical properties by converting them underground into their vapor-phase fractions, recovering said fractions at the surface and synthesizing said fractions into high-performance liquid and gaseous products of marketable quality.

The present invention is directed to a process for the thermobaric production of hydrocarbons from an underground natural reservoir. The process starts with penetrating the natural reservoir with one or more wellbores. A thermal energy reactor is introduced into the natural reservoir through one or more of the wellbores at or below a horizon of the natural reservoir. Gasifying agents are transmitted down the wellbore opposite the natural reservoir. In this context, "opposite" means to the same or equivalent depth as the natural reservoir. Target hydrocarbons within the natural reservoir are converted underground into corresponding vapor phase hydrocarbon fractions. The vapor phase hydrocarbon fractions are recovered at wellheads of the wellbores and condensed into liquid and gaseous hydrocarbon products.

The injecting step may include transmitting heat energy into the natural reservoir through the thermal energy reactor in the presence of steam. The heat energy preferably comprises atmospheric air heated to a temperature of 2000° C. or greater. The transmitting step may include transmitting the heat energy from a lower-half of the horizon to a top of the horizon by forced convective mass transfer resulting from temperature and pressure gradients in a vertical plane of the natural reservoir.

The converting step preferably includes disintegrating low-porosity and low-permeability rock in the natural reservoir under increased pressure in response to increased temperature from the thermal energy reactor. The converting step preferably includes undermining impermeable rock in the natural reservoir by volumetric and dilatant decompaction of the impermeable rock in front of an advancing heat wave.

The target hydrocarbons preferably comprise heavy hydrocarbon factions having boiling points above 350° C. In this instance, the converting step preferably includes burning off a first portion of the heavy hydrocarbon fractions and evaporating to a vapor phase a remaining portion of the heavy hydrocarbon fractions.

The process may further include passing the recovered vapor phase hydrocarbon fractions through a gravel pack composed of fine carbonate material. After the condensing step, any uncondensed vapor phase hydrocarbon fractions may be routed to a gas distribution system for use as fuel gas.

The process may further include filling the wellbores with liquid hydrocarbons at a level of a productive formation of hydrocarbons, and increasing a temperature of the liquid hydrocarbons to a fire point of the fluid hydrocarbons. The liquid hydrocarbons preferably result in the generation of a sufficient concentration of hydrocarbon vapors for ignition, which is achieved at a fuel temperature of 100° C. The hydrocarbon vapors are then ignited using a surface ignition device. The step of increasing a temperature preferably includes injecting heated air through the thermal energy reactor. The process preferably includes feeding an oxidizer into the wellbores proximate to the thermal energy reactor.

The igniting step preferably includes igniting hydrocarbon vapors in an annulus proximate to the thermal energy reactor at an air-to-fuel ratio greater than one. The process further includes decomposing through high-temperature pyrolysis the hydrocarbon vapors outside of the annulus proximate to the thermal energy reactor. The pyrolysis occurs by shock heating of the crude throughout the wellbores at an air-to-fuel ratio that decreases from one to zero from the horizon to the wellheads.

The igniting step comprises generating three high-temperature zones in the wellbores, including:

- a reactor oxidation zone, wherein a stream of heated atmospheric air from the thermal energy reactor forms gases at approximately 2000° C.;
- a reactor hot-gas dilution zone, wherein gases rising from the reactor oxidation zone are cooled by atmospheric air to between approximately 700° C. and approximately 900° C., and superheated steam forms $CO^-$ and $H^+$ ions;
- a methane synthesis zone, wherein the $CO^-$ and $H^+$ ions rising from the reactor hot-gas zone form methane between approximately 300° C. and approximately 500° C.

The process further includes generating localized pressure reductions throughout the natural reservoir via vacuum degasification. The converting step preferably includes creating a temperature gradient that corresponds to a target pressure gradient in the natural reservoir from the thermal energy reactor into rock surrounding the wellbores.

The process may further include adding liquid catalysts, atmospheric air, water and mixed gasification products through well tubing or annulus of the wellbores into a bottomhole zone and into the natural reservoir, and then re-gasifying solid, low-hydrogen/high-carbon residue remaining in the natural reservoir after converting target hydrocarbons into corresponding hydrocarbon vapor phase fractions. The process may also include liquefying the re-gasified solid, low-hydrogen hydrocarbon for subsequent recovery at the wellheads.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
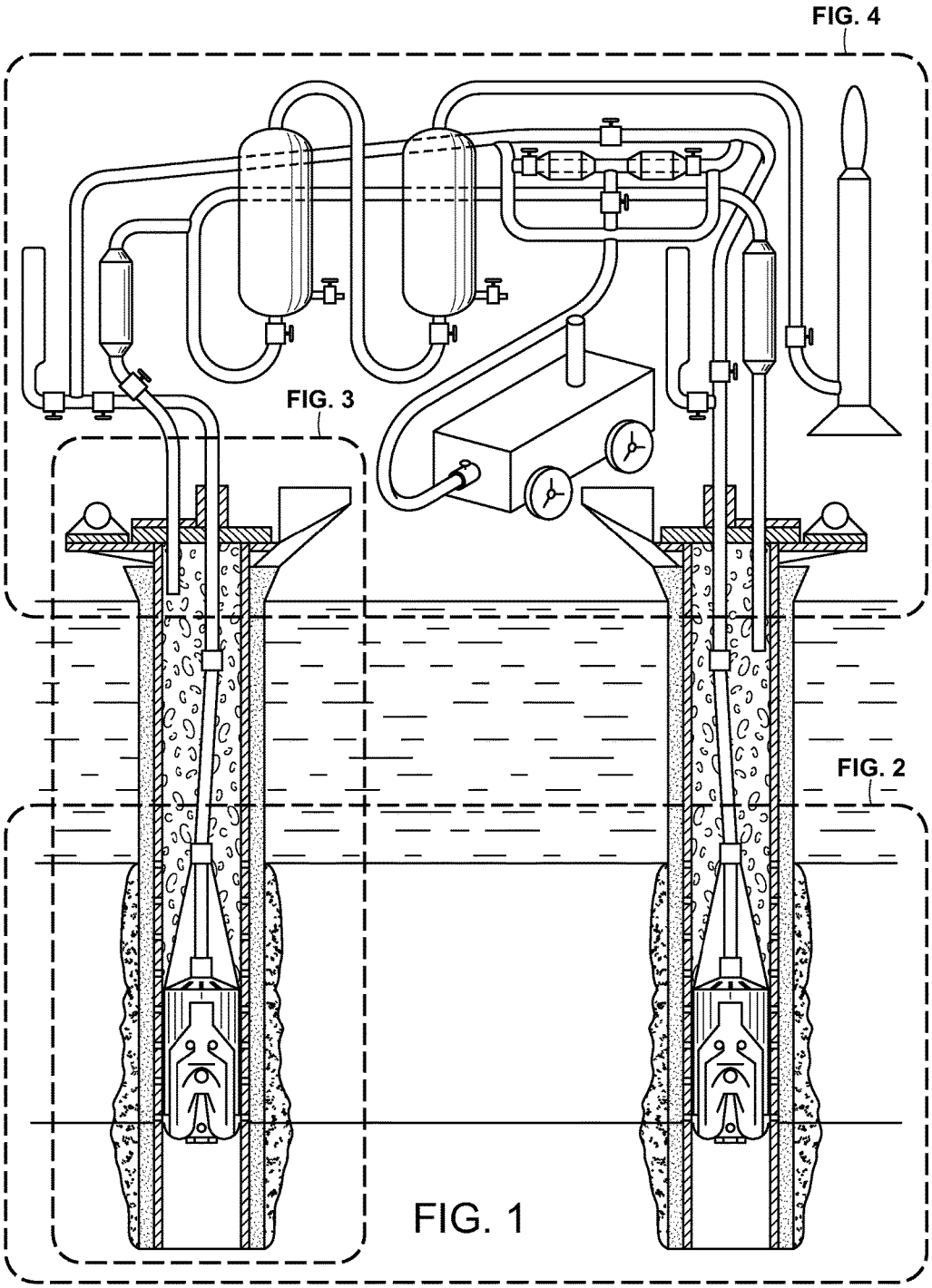
FIG. 1 is an overall schematic illustration of the system used to implement the present invention.
Figure 2:
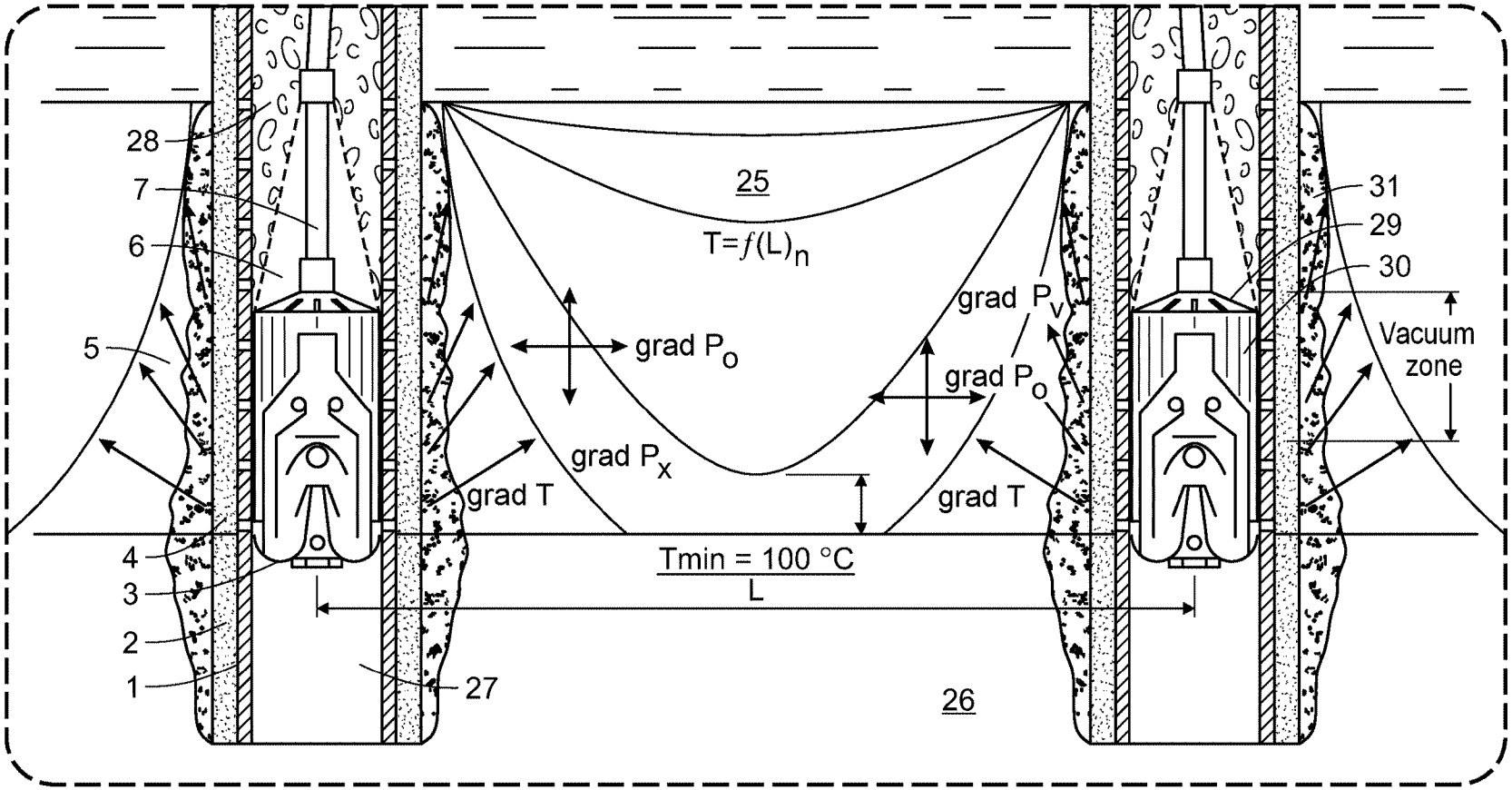
FIG. 2 is a close-up of FIG. 1 as indicated by box FIG. 2, showing a graphical illustration of boreholes and a horizon of a natural reservoir including a plot of pressure and temperature gradients.
Figure 3:
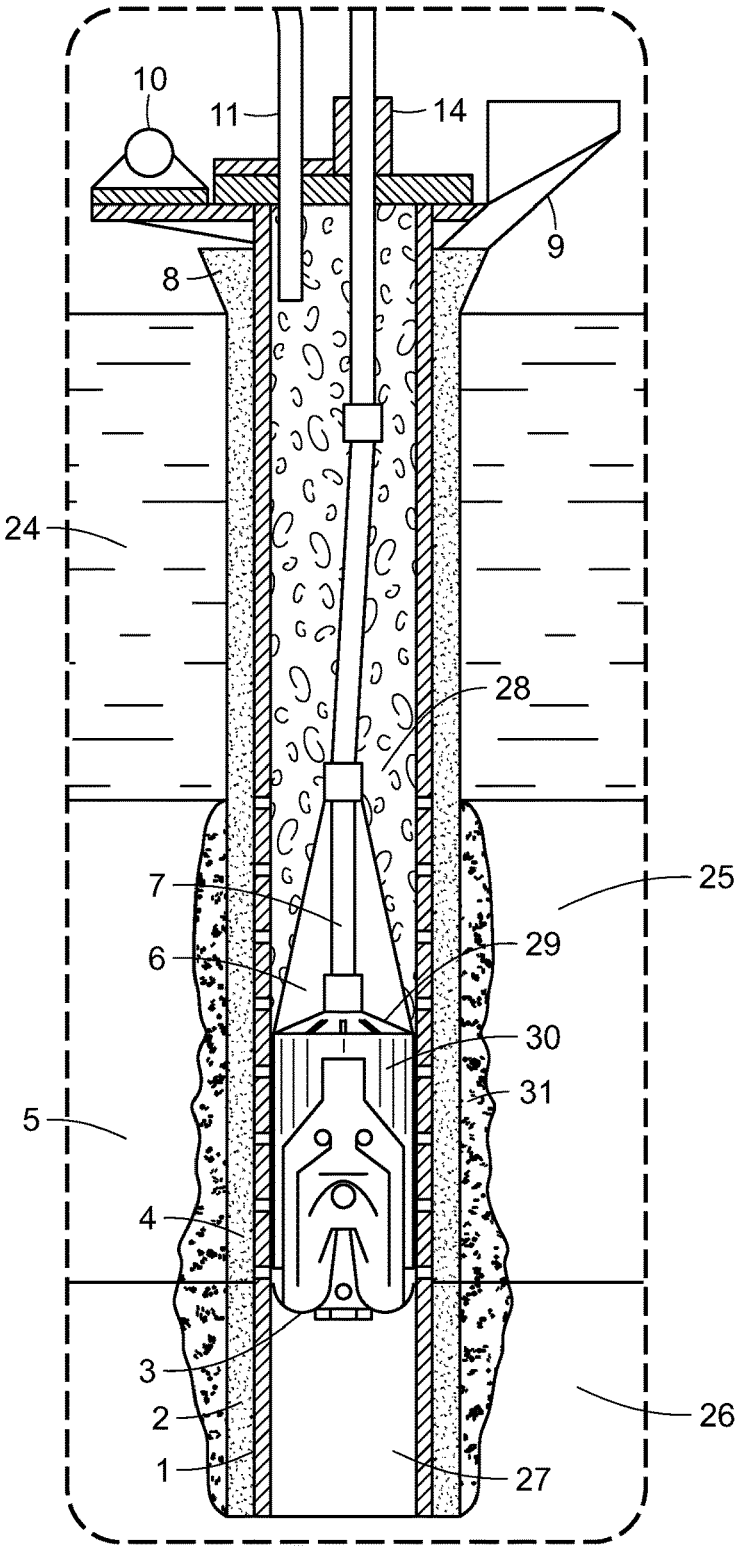
FIG. 3 is a close-up of FIG. 1 as indicated by box FIG. 3, showing an illustration of a borehole in a natural reservoir according to the present invention.
Figure 4:
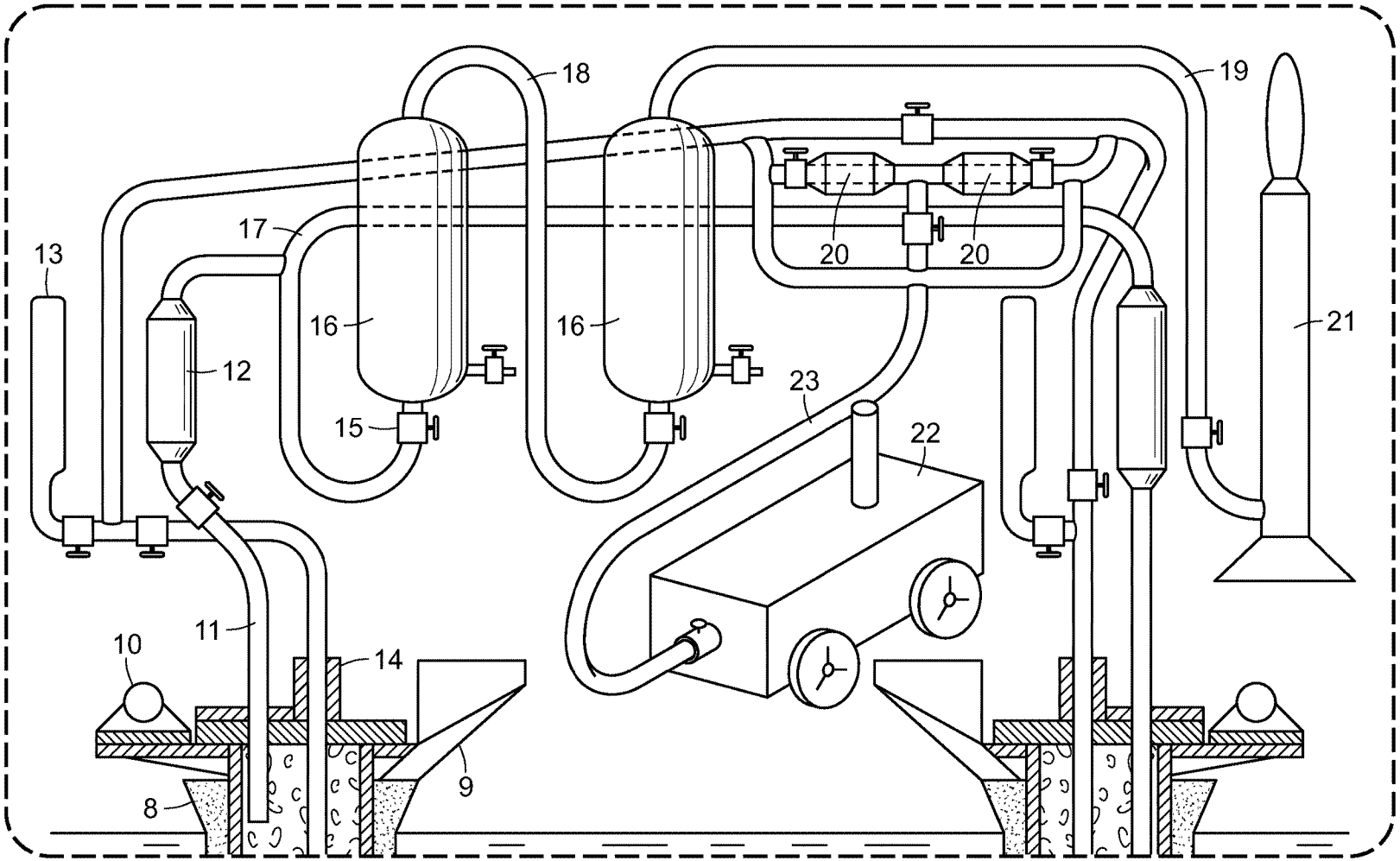
FIG. 4 is a close-up of FIG. 1 as indicated by box FIG. 4, showing a schematic illustration of surface equipment for a system to implement the present invention.

The present invention is directed to a system and method for the thermobaric production of hydrocarbons from a natural reservoir, with a preferred embodiment of the system as illustrated in FIGS. 1-4.

The method for underground production of hydrocarbons from their depths of occurrence through conventional wells consists of the following basic stages: (a) penetration of a natural reservoir by wells, (b) injection of gasifying components through the tubing of said wells, (c) underground transformation of the target hydrocarbons into a mobile, flowing consistency by converting said hydrocarbons into their fluid or vapor phase fractions, and (d) delivery of the said vapor phase fraction to the surface for subsequent condensation to form marketable, high-performance liquid and gaseous products directly at the well surface. The movement of in-situ flowing hydrocarbons throughout the interwell volume of a natural HC reservoir is dynamically affected during withdrawal by the spatially changing direction of local pressure gradient trajectories towards the nearest well bottomhole from every point within said reservoir, assuming that the initial pressure gradients are created in conjunction with a temperature gradient produced at a high-temperature thermal energy source (reactor), followed by generation of subsequent pressure gradients within the hydrocarbon-saturated body of said productive reservoir via heat and mass transfer of the flowing medium at a capillary level under conditions of forced convective heat exchange.

Low-porosity and low-permeability rock throughout said reservoir will immediately undergo disintegration under the impact of temperature fields as pore pressure increases in response to the rising temperature gradient. A 1° C. increase in temperature will raise pore pressure by up to 4 atm.

More resistant, impermeable rock, i.e. hard coal, will be undermined layer-by-layer by temperature fields generated at the face of the advancing heat surface, resulting in initial volumetric dilatant decompaction of the rock mass in the interwell space at the pre-development phase of said reservoir.

The source of high-temperature thermal energy (reactor) must be located at or directly below the base of the target reservoir horizon. Heat energy is transmitted by the high-temperature thermal energy source to the nearest specified reservoir horizon from the lower half-space of the horizon to its top via forced convective mass transfer generated by natural (gravitational) temperature and pressure gradients within a vertical plane.

The mobile liquid and heavy gas fractions formed at a specified temperature within the productive reservoir seep downward towards the high-temperature thermal energy source (reactor), where a portion of the heaviest fractions is burned off and a portion evaporated to form a vapor-phase, which is then directed to the surface via the well tubing or annulus.

To launch the process of underground transformation of hydrocarbons into a mobile, flowing consistency, the well is first filled with fluid hydrocarbons at the level of the productive formation. The temperature of said hydrocarbons is then increased to the fire point by injecting them from the surface with air that has been heated to a set temperature. Then, in the well annulus near the high-temperature thermal energy source, the fluid is decomposed via centrifugal forces to create proper burning conditions at the high-temperature thermal energy source (reactor), which is now submerged in a liquid medium or a heavy hydrocarbon gas medium, by feeding an oxidizer from the surface into the combustion zone, either through the well tubing or annulus.

The resulting vapor-phase hydrocarbon fraction of this mixture is then directed to the surface via the well tubing or annulus. The recovered vapor-phase hydrocarbons pass through a distillation column where they undergo condensation to form liquid HC fractions that are further stabilized and converted into marketable products. Any uncondensed gas and vapor fractions remaining after this process are routed to the gas distribution system for use as fuel gas.

The process of combustion of heavy liquid or gaseous hydrocarbon fractions at the high-temperature thermal energy source (reactor) occurs at an air-to-fuel ratio greater than one ($\alpha>1$). Outside the reactor zone, hydrocarbons undergo high-temperature pyrolysis through shock heating into a vapor-phase state throughout the annulus and tubing side of the well at an air-to-fuel ratio that decreases upsection (bottomhole to wellhead) from one to zero ($1>\alpha=0$).

The wellbore in the zone of the productive reservoir is filled above the liquid surface with heavy hydrocarbon fractions having a high vaporization point in order to obtain a sufficient vapor concentration for ignition, which is achieved at a fuel temperature of 100° C. After the necessary vapor concentration has been reached for ignition, said vapors are fired from a purpose-built flare located on the surface.

The flame is then transmitted downhole through the well annulus or tubing, into which air and heavy hydrocarbon vapors have already been injected to achieve the minimum vapor concentration necessary for ignition and non-explosive migration of the combustion front through the air column to the well bottomhole where the hydrocarbon vapor/air mixture undergoes combustion at the high-temperature thermal energy source (reactor), which now operates non-stop to generate high-temperature thermal energy to support a continuous process.

During this process, the following planned high-temperature zones are formed at the thermal energy source and in the wellbore:

1) Reactor hydrocarbon oxidation zone, where under the influence of the atmospheric air stream, gases are formed at a temperature of approximately 2000° C.
2) Reactor hot-gas dilution zone, where said gases are cooled by atmospheric air to temperatures ranging from 700° C. to 900° C., during which superheated steam contained in the hydrocarbons, as well as steam injected from the surface together with air, forms the CO and H ions needed for methane (CH4) synthesis in the next temperature zone.
3) Methane (CH4) synthesis zone, where CO and H ions contained in the gas-vapor medium are synthesized into methane at temperatures from 300° C. to 500° C. The zone is located above the high-temperature thermal energy source (reactor) in the well annulus or tubing.

Localized pressure reductions are generated throughout the target reservoir or in individual sections of said reservoir via vacuum degasification directly on the inside surface of the perforated casing and then in the reservoir itself, thereby producing an ejection effect generated by the whirl velocity of the eddying stream in the annulus.

At a constant, controlled temperature, increases in pressure and flow rate at each stage of the process will remain within a pre-specified range through the use of valves to adjust the flow area within design specifications at the mouth of the well tubing and annulus, and are controlled based on changes in the temperature of the gas-vapor mixture at the outlet from the annulus (tubing) to keep said pressure and flow rate increases within permissible limits. As a result, the productivity of this process is enhanced with respect to the volume of the gas-vapor mixture recovered at the wellhead from the bottomhole.

The propagation of the temperature field from the high-temperature thermal energy source (reactor) along the radius from the reactor in the wellbore to the surrounding rock is achieved by creating a design temperature gradient that corresponds to the target pressure gradient. This process results in the formation of a pressure gradient corresponding to the temperature gradient, thereby inducing heat-and-mass transfer of the flowing media in the pore space of the reservoir under conditions of forced convective heat exchange. In this way, the flow of liquid and heavy vapor-phase hydrocarbon fractions into the zone of the high-temperature thermal energy source (reactor) is increased in accordance with the cube law to the point where the design temperature fields of all wells within a specified radius are joined and the inflow of liquid and heavy vapor phase fractions in each well reaches its maximum.

After productivity reaches its peak, the withdrawal of the vapor-phase hydrocarbon mixture declines in accordance with the cube law, while the design high-pressure of the vapor-phase mixture is maintained in the reservoir (reservoir pressure) to provide the planned completeness of hydrocarbon recovery (up to 80-90%) by reducing the flow area at the wellhead to sizes needed to stabilize the process within design parameters.

After penetration by wells, resistant and low-permeability reservoir structures undergo volumetric decompaction through the wellbore in a regime of dilatant deformation produced by the superposition of pre-calculated wave fields created downhole within the reservoir mass by dedicated wave generators or by confined explosions using explosive materials of defined strength, i.e. low-strength materials, that do not threaten the structural integrity of the well casing or downhole and wellhead components.

A notional model of a system for implementing the described method for underground production of solid, liquid and gaseous hydrocarbons from a natural reservoir, including coal, heavy and bituminous oil and dissipated (shale) hydrocarbons, is presented in FIGS. 1-4, which represents a schematic diagram of hydrocarbon production that includes all process components, equipment and infrastructure for two neighboring wells drilled into the horizon of a natural reservoir.

The productive reservoir 25 is penetrated from the surface by cased wells 1, the annulus spaces of which are filled with a dry, flowing, sandy packing medium 2. The casing opposite the reservoir zone 25 is then perforated and a gravel pack 4 is set in the borehole annulus and the washed out volume of the reservoir is filled with a fine, particulate inorganic catalyst 31. A high-temperature thermal energy source (reactor) 3 is set in the lower zone of the reservoir, where it is suspended from the well tubing 7. The zone of the high-temperature thermal energy source (reactor) opposite the reservoir is encircled by the wellbore zone of the reservoir, which has undergone high-temperature drying at the temperature of superheated steam 5. A vortex generator is installed on the outside diameter of the high-temperature thermal energy source (reactor) to generate a vacuum cone 6 within the eddying stream in the well annulus.

At the wellhead, the borehole annulus is equipped with a funnel 8 to feed loose, dry packing material (fine sand). A hopper 9 filled with dry packing material is installed over the funnel 8 to ensure uninterrupted delivery of packing material into the borehole annulus. A vibrator 10 is installed on the outside casing flange to direct the packing material into the borehole annulus via vibrotransport. An outlet pipe 11 extends from the annulus to withdraw the hot vapor-phase hydrocarbon mixture from the well. At the wellhead, the pipe is equipped with a gravel pack 12 composed of fine carbonate material designed to remove sulfur from the hydrocarbons.

A water tank 13 is installed at the wellhead to feed water into the tubing together with air. The end of the well tubing 7 at the wellhead is suspended on a collar 14.

The air flow rate at the tubing inlet, the consumption of water, the recovery of the vapor-phase hydrocarbon mixture from the well and the process of condensation in columns are all controlled by valves 15. The recovered vapor-phase hydrocarbon mixture is directed to condensation columns 16 via pipes 17 and intercolumn pipe 18. High temperature gas mixtures are sent via pipe 19 to the flare 21.

An electrothermal heater 20 warms the air injected into the well to its design temperature, but only at the start of the process. Compressed air is injected into the well tubing from the compressor 22 via a feed line 23.

The reservoir rock mass 25 forms contacts with the overlying horizon 24 at its top and the underlying horizon 26 at its base. A rathole section 27 is set under the reactor.

A vertical hydrocarbon shock heating zone is created in the annulus, above the vortex generator which has been installed on the outside diameter of the reactor 3. A vacuum generator 30 with vacuum cartridge 29 is installed directly above the vortex generator on the inside wall of the well casing.

The process diagram illustrates the graphical function T=f(L)n, which characterizes the change in temperature within the interwell space as the reservoir undergoes heating. The diagram further illustrates the relative temperature and pressure gradients in the same interwell space.

$T_{min}$=100° C. is the temperature at which the thermal fields of two wells meet to form a flow bond between the wells grad T is the direction of maximum temperature gradients (temperature drops).

grad $P_o$ is the direction of maximum pressure gradients (drops) on the horizontal plane.

grad $P_v$ is the direction of maximum pressure gradients (drops) on the vertical plane.

The process is initiated by filling the well tubing or annulus with liquid hydrocarbon fractions, e.g. diesel fuel, to cover the entire reservoir section 25 and the drilled rathole 27. The compressor 22 is activated and compressed air is injected at design pressure to the bottomhole through the well tubing 7.

At the start of the process, compressed air is heated at the surface by passing through the heater 20, until the hot air reaches a hydrocarbon evaporation temperature in the well that is sufficient to ignite hydrocarbon vapors above the liquid phase and support stable combustion. As it moves down the well tubing, the air, after being heated to the design temperature, forces liquid-phase hydrocarbons out of the reactor space, passes through the reactor, and upon exit from the reactor, turns and begins to move up the annulus, passing the vortex generator mounted on the outside surface of the reactor 3, where it begins to spiral, forming in the annulus a vacuum cone within the eddying stream to support the combustion process in the reactor 3, which is submerged in a liquid medium. A vertical shock (flash) heating zone is formed higher in the annulus, where cold hydrocarbons become mixed with hot hydrocarbons.

After the compressed air has reached its design temperature and the concentration of hydrocarbon vapors in the annulus is adequate for smooth combustion, the mixture at the mouth of the annulus is ignited by a piezoelectric spark generator (or another type of ignition device) threaded onto the Xmas tree nipple or directly onto pipe 11 to provide an outlet for the hot vapor phase hydrocarbons from the annulus.

After the concentrated hydrocarbon vapor mixture in the annulus has been ignited at the surface, conditions are created for non-explosive travel of the flame front, which moves down the annulus towards the bottomhole until it reaches the reactor zone, where temperature is gradually increased, first in the reactor zone and then within the reactor itself. Liquid hydrocarbon fractions are forced from the sump into the combustion zone of the reactor 3, where said fractions undergo controlled combustion, resulting in intensive heat generation in the reactor zone 3 and the transmission of said heat to the surrounding reservoir rock.

After the combustion process has been initiated in the reactor, heating of the air injected via the well tubing is stopped and pre-heated air is injected downhole immediately following compression.

As soon as this process has been initiated, output parameters begin to assume their design specifications. The pressure and temperature of the gas-vapor mixture in the reactor and in the annulus are controlled by air pressure at the tubing head and by the volume of water injected with air into the combustion zone, together with the pressure and volume of the gas-vapor mixture recovered at the wellhead. The process is monitored and controlled at the wellhead by installing pressure, temperature and flowrate sensors in the annulus, and pressure and water- and air-injection gauges at the intake to the well tubing.

By controlling these parameters from the wellhead, the previously discussed high-temperature zones—hydrocarbon oxidation zone, hot-gas dilution zone, and methane synthesis zone—are formed in the reactor zone 3 and in the wellbore.

Directly at the outlet of the high-temperature energy source (reactor 3), in the space between the well casing and the outside diameter of the reactor 3, the vortex generator installed on the outside surface of the reactor 3 produces intense eddying of the high-temperature gas mixture 28 at temperatures up to 700° C. Liquid and heavy gaseous hydrocarbons seeping out along the well annulus from the productive section enter said mixture, where they are actively intermixed with liquid and heavy gaseous hydrocarbon fractions draining into the bottomhole after the natural hydrocarbon reservoir 25 has been heated to a set temperature for subsequent shock (flash) heating to temperatures ranging from 450° C. to 500° C. During this process, hydrocarbons undergo high-temperature pyrolysis to produce gas-vapor fractions, accompanied by the release of thermal energy sufficient to run the process of hydrocarbon conversion into a gas-vapor state without additional heat from the high-temperature thermal energy source (reactor) via the Galoter process. Therefore, after initiating the process of high-temperature pyrolysis, the need for downhole injection of air from the compressor 22 is minimized or eliminated, and the process becomes wholly or partially self-sustaining, depending on the quality of the downhole parameter control system.

The process of high-temperature pyrolysis occurs in the presence of a liquid catalyst, e.g. lube oil obtained from mica-schist processing, which facilitates near-complete conversion of all heavy hydrocarbon fractions into a vapor-phase state.

Highly porous flowing media with an increased specific surface area—for example montmorillonite—are used as dry inorganic catalysts 31 in the borehole annulus or in the washed-out volume of the bottomhole zone of the reservoir 25, in which capacity they increase the fractional distillation rate of reservoir oil by up to 50 times and the mass of the distilled oil in a porous medium by up to 8 times over fractional distillation of free oil The solid, low-hydrogen residue remaining after gasification (carbon), beginning from the junction of the temperature fields from all wells within a certain radius, is subsequently re-gasified by injecting liquid catalysts, e.g. mica-schist oil, resulting in near-complete gasification of carbon residue and conversion of said residue into a flow-phase state. During this process, the liquid catalyst, along with atmospheric air, water and mixed gasification products, is fed through the well tubing or annulus into the wellbore zone and then into the reservoir 25 itself.

The solid, low-hydrogen hydrocarbon residue remaining after completion of production is converted into a solution (emulsion) and recovered at the surface after being pumped out of the wells.

The high-temperature vapor-gas stream recovered at the wellhead first passes through an ultra-fine carbonate medium (gravel) where sulfur is removed from the vapor-phase hydrocarbons.

In the zone of the high-temperature thermal energy source (reactor), the borehole annulus and a specially washed-out volume of the reservoir is filled with a fine, particulate, inorganic catalyst—a highly porous flowing medium with an increased specific surface area, such as montmorillonite—which increases the fractional distillation rate of reservoir oil by up to 50 times and the mass of the distilled oil in a porous medium by up to 8 times over fractional distillation of free oil.

Therefore, this method supports the underground conversion of hydrocarbons into their vapor-phase fractions for subsequent recovery at the surface, where they undergo condensation to create profitable products of marketable quality.

The foregoing description is presented as an example of the use of this technology, and as such serves an illustrative purpose, but does not limit other potential implementation options.

The processes and apparatuses described herein have a number of particular features that should preferably be employed in combination, although each is useful separately without departure from the scope and spirit of the invention. Although a preferred embodiment has been described in detail for purposes of illustration, various modifications may be made without departing from the scope and spirit of the invention. Accordingly, the invention is not to be limited, except as by the appended claims.

What is claimed is:

1. A process for the thermobaric production of hydrocarbons from an underground natural reservoir, comprising the steps of:

penetrating the natural reservoir with one or more wellbores;

filling the natural reservoir with fluid hydrocarbons to a level of a productive formation within the natural reservoir;

introducing a thermal energy reactor into the natural reservoir through one or more of the wellbores at or below a horizon of the natural reservoir;

transmitting gasifying agents into the wellbores opposite the natural reservoir;

injecting heated air into the fluid hydrocarbons through the thermal energy reactor to increase the temperature of the fluid hydrocarbons to a fire point;

converting target hydrocarbons underground within the natural reservoir into corresponding vapor phase hydrocarbon fractions;

recovering the vapor phase hydrocarbon fractions at wellheads of the wellbores; and condensing the vapor phase hydrocarbon fractions to liquid and gaseous hydrocarbon products.

2. The process of claim 1, wherein the injecting step includes transmitting heat energy into the natural reservoir through the thermal energy reactor in the presence of steam.

3. The process of claim 2, wherein the heat energy comprises atmospheric air heated to a minimum temperature of 2000° C.

4. The process of claim 2, wherein the converting step includes disintegrating low-porosity and low-permeability rock in the natural reservoir under increased pressure in response to increased temperature from the thermal energy reactor.

5. The process of claim 2, wherein the converting step includes undermining impermeable rock in the natural reservoir by volumetric and dilatant decompaction of the impermeable rock in front of an advancing heat wave.

6. The process of claim 2, wherein the transmitting step includes transmitting the heat energy from a lower-half of the horizon to a top of the horizon by forced convective mass transfer resulting from temperature and pressure gradients in a vertical plane of the natural reservoir.

7. The process of claim 1, wherein the target hydrocarbons comprise heavy hydrocarbon factions having boiling points above 350° C. and the converting step includes burning off a first portion of the heavy hydrocarbon fractions and evaporating to a vapor phase a remaining portion of the heavy hydrocarbon fractions.

8. The process of claim 1, further comprising the step of passing the recovered vapor phase hydrocarbon fractions through a gravel pack composed of fine carbonate material.

9. The process of claim 1, further comprising routing any uncondensed vapor phase hydrocarbon fractions remaining after the condensing step to a gas distribution system for use as fuel gas.

10. The process of claim 1, further comprising the steps of:

generating a sufficient concentration of hydrocarbon vapors for ignition, which is achieved at a fuel temperature of 100° C.; and igniting the hydrocarbon vapors in an annulus proximate to the thermal energy reactor using a surface ignition device, wherein the hydrocarbon vapors are at an air-to-fuel ratio greater than one.

11. The process of claim 10, further comprising the step of feeding an oxidizer into the wellbores proximate to the thermal energy reactor.

12. The process of claim 10, further comprising the step of decomposing through high-temperature pyrolysis the hydrocarbon vapors outside of the annulus proximate to the thermal energy reactor.

13. The process of claim 12, wherein the pyrolysis occurs by shock heating throughout the wellbores at an air-to-fuel ratio that decreases from one to zero from the horizon to the wellheads.

14. The process of claim 10, wherein the igniting step comprises the step of generating three high-temperature zones in the wellbores, wherein the three high-temperature zones comprise:

a reactor oxidation zone, wherein a stream of heated atmospheric air from the thermal energy reactor forms gases at approximately 2000° C.;

a reactor hot-gas dilution zone, wherein gases rising from the reactor oxidation zone are cooled by atmospheric air to between approximately 700° C. and approximately 900° C., and superheated steam forms CO— and H+ ions; and a methane synthesis zone, wherein the CO— and H+ ions rising from the reactor hot-gas zone form methane between approximately 300° C. and approximately 500° C.

15. The process of claim 1, wherein the converting step includes creating a temperature gradient that corresponds to a target pressure gradient in the natural reservoir from the thermal energy reactor into rock surrounding the wellbores.

16. The process of claim 1, further comprising the steps of:

adding liquid catalysts, atmospheric air, water and mixed gasification products through well tubing or annulus of the wellbores into a bottomhole zone and into the natural reservoir; and re-gasifying solid, low-hydrogen residue remaining in the natural reservoir after the step of converting target hydrocarbons into corresponding hydrocarbon vapor phase fractions.

17. The process of claim 16, further comprising the step of liquefying the re-gasified solid, low-hydrogen hydrocarbon for subsequent recovery at the wellheads.

18. The process of claim 1, further comprising the step of producing volumetric compaction in the natural reservoir by superposition of wave fields created by wave generators or confined explosions in the natural reservoir.

19. A process for the thermobaric production of hydrocarbons from an underground natural reservoir, comprising the steps of:

penetrating the natural reservoir with one or more wellbores;

introducing a thermal energy reactor into the natural reservoir through one or more of the wellbores at or below a horizon of the natural reservoir;

transmitting gasifying agents into the wellbores opposite the natural reservoir;

converting target hydrocarbons underground within the natural reservoir into corresponding vapor phase hydrocarbon fractions;

generating localized pressure reductions throughout the natural reservoir via vacuum degasification so as to produce an ejection effect in the wellbores;

recovering the vapor phase hydrocarbon fractions at wellheads of the wellbores; and condensing the vapor phase hydrocarbon fractions to liquid and gaseous hydrocarbon products.

* * * * *